United States Patent [19]

Kawamata et al.

[11] Patent Number: 4,490,826

[45] Date of Patent: Dec. 25, 1984

[54] METHOD OF RESETTING ANODE SPIKE

[75] Inventors: Yutaka Kawamata, Tokyo; Akira Matsuo, Ebina, both of Japan

[73] Assignee: Mitsubishi Light Metal Industries Limited, Tokyo, Japan

[21] Appl. No.: 379,708

[22] Filed: May 19, 1982

[30] Foreign Application Priority Data

Jun. 2, 1981 [JP] Japan ..... 56-84700

[51] Int. Cl.[3] ..... C25C 3/06; H01J 1/02

[52] U.S. Cl. ..... 373/97; 313/327; 313/332; 204/243 R; 204/67

[58] Field of Search ..... 204/243 R, 294, 67; 313/327, 332; 373/97

[56] References Cited

U.S. PATENT DOCUMENTS 2,475,452 7/1949 Jouannet ..... 373/97

FOREIGN PATENT DOCUMENTS 5534682 9/1978 Japan .

*Primary Examiner*—Aaron Weisstuch
*Assistant Examiner*—Nathan Thane
*Attorney, Agent, or Firm*—Oblon, Fisher, Spivak, McClelland & Maier

[57] ABSTRACT

A method of resetting an anode spike in a vertical type Söderberg electrolytic furnace for aluminum, comprising inserting at least one paste block prepared by molding packing paste into a configuration conforming to that of the top end of a spike in the spike pit formed after pulling out the spike, and setting the spike again.

3 Claims, 3 Drawing Figures

METHOD OF RESETTING ANODE SPIKE

BACKGROUND OF THE INVENTION (1) Field of the Invention

The present invention relates to a method of resetting an anode spike. More particularly, the present invention relates to a method of forming a satisfactory secondary anode in the spike pit formed after pulling out the spike in the case where the anode of a vertical type Söderberg electrolytic furnace for aluminum is consumed from its bottom thereby necessitating to reset the spike.

(2) Description of the Prior Art

As has been well-known, a vertical type Söderberg electrolytic furnace for aluminum is operated under the condition of keeping the molten electrolyte and the molten aluminum metal between a carbon cathode of the furnace body and a carbon anode (primary anode) suspended by spikes.

In a large electrolytic furnace, such carbon anode is suspended by as many as 50–60 spikes and is gradually comsumed from its bottom surface (for example by 14–15 mm per day) as the electrolysis proceeds. When the lower end of a spike comes to a predetermined height from the bottom surface of the carbon anode, the spike is pulled out and then set again at an adjusted height corresponding to the consuming rate of the anode. Since a pit is formed in the anode body after pulling out the spike, it is necessary to charge the pit with a packing paste previously prepared by compounding coke and pitch thus forming the secondary carbon anode, prior to the resetting of the spike.

Since the packing paste thus charged into the pit is subjected to rapid baking, the carbon anode thus formed (secondary anode) is porous and fragile, and has poor bondability with the primary anode. Thus, it may fall out of the primary anode during furnace operation thereby leading to anode troubles or increasing the contact resistance between the spike and the primary anode due to poor bondability. Furthermore, in order to avoid the undesirable effect caused by the formation of cavities after the falling out of the secondary carbon anode, the spike has to be maintained at a position considerably above the bottom surface of the primary anode, thereby causing an increase of the voltage drop through the anode.

Methods for overcoming such disadvantages are disclosed respectively in Japanese Patent Application Nos. 2724/1980 and 34682/1980.

Japanese Patent Application No. 2724/1980 proposes a secondary anode paste for use in a vertical type Söderberg electrolytic furnace for aluminum, in which the amount of finer particles compounded in the aggregate and the amount of a binder compounded with the aggregate have been increased respectively as compared to those in the primary anode paste. Specifically, while in the primary anode paste in general the finer particles which pass through Tyler standard mesh #200 occupy 30–40% by weight of the aggregate and the binder content is 25–35% by weight of the total amount of the paste, in the secondary anode paste the finer particles occupy 40–60% by weight of the aggregate and the binder content is 35–55%, preferably, 40–50% by weight of the total amount of the paste. It is also described therein that such secondary anode paste liquefies in a short time after being charged into the spike pits and then the liquefied paste rises up into any slight gap around the periphery of the spike to ensure sufficient electrical contact between the spike and the primary anode upon insertion of the spike, as well as forming a satisfactory secondary anode around and below the spike.

Japanese Patent Application No. 34682/1980 proposes a method of inserting a baked block of a configuration conforming to that of the top end of a spike into each of pits formed in the anode after pulling out the spike and, thereafter, setting the spike again. The baked block used in this method is prepared by starting from a secondary anode paste as the raw material containing an aggregate having a particle size distribution giving to the secondary anode substantially the same consuming property as that of the primary anode and a binder content of less than about 20% by weight which is lower than the content of about 30% by weight in the primary anode paste, molding the raw material into a desired configuration and, thereafter, baking it at 500°–1100° C. In the case where the anode has a non-flowable upper layer a method of using the baked block in combination with the secondary anode paste as described in Japanese Patent Application No. 2724/1980 is also proposed.

The present inventors have made studies for forming a secondary anode in the spike pits upon replacing the anode spike and have found that desirable effects comparable with those obtained by the method of using the baked block disclosed in Japanese Patent Application No. 34682/1980 can be attained by charging a molded packing paste into the spike pit and that the above-mentioned object can be attained much more economically, and have accomplished the present invention.

SUMMARY OF THE INVENTION

An object of the present invention is to provide a method of resetting an anode spike in an electrolytic furnace for aluminum.

Another object of the present invention is to provide a method of resetting an anode spike in a vertical type Söderberg electrolytic furnace for aluminum, by which a secondary anode can be economically formed in the pit formed after pulling out the anode spike.

The present invention proposes a method of resetting an anode spike in a vertical type Söderberg electrolytic furnace for aluminum, comprising inserting at least one non-melting paste block prepared by molding a packing paste into a configuration conforming to that of the top end of the spike in the spike pit formed after pulling out the spike, and setting the spike again.

DETAILED DESCRIPTION OF THE INVENTION

The present invention will now be explained in more detail.

Figure 1:
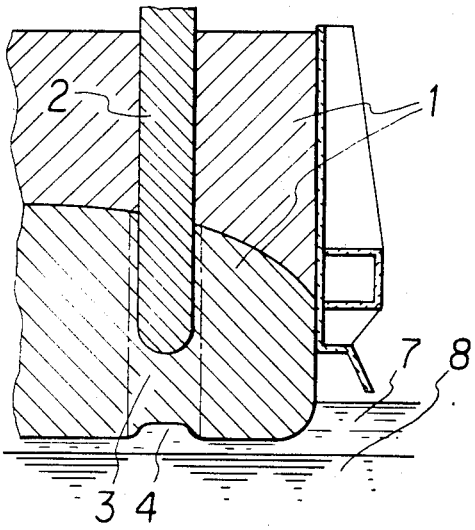
FIG. 1 is a schematic cross-sectional view of the anode portion of an electrolytic furnace for aluminum for illustrating the manner of resetting an anode spike by a conventional method.

FIG. 1 is a schematic cross-sectional view of an anode portion for illustrating the manner of resetting an anode spike by way of a conventional method. In the drawing, are shown a primary anode (carbon anode) 1, a spike 2, a secondary anode (packing paste) 3, a recess 4 at the bottom of the secondary anode, molten electrolyte 7 and molten aluminum metal 8.

Figure 2:
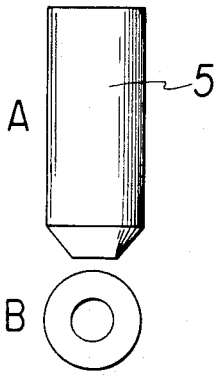
FIG. 2 is a schematic view for one embodiment of the paste block configuration of the present invention, in which A is its side elevational view and B is a view from its bottom end.

The non-melting paste block to be charged in a pit formed after pulling out the spike is prepared by molding a packing paste into the configuration conforming to that of the top end of the spike. The packing paste includes an aggregate of coke containing generally 20–40% by weight of fine particles which pass through Tyler standard mesh #200, and, preferably, at substantially the same content as that in the carbonaceous paste used for the preparation of the primary anode, and pitch as a binder at a content of 15–25%, preferably, 18–23% by weight of the total amount of the paste. Suitable content of the binder may also vary depending on the distribution of particle size of the aggregate of coke. The pressure required for the molding may also depend on the distribution of particle size of the aggregate of coke, the composition of the binder pitch and the like and it is, usually, of about 50–500 kg/cm$^2$ and, preferably, 100–300 kg/cm$^2$. FIGS. 2A and B are a schematic side elevational view and bottom view for one embodiment of the configuration for the paste block 5, respectively.

According to the present invention, a satisfactory secondary anode can be formed below the spike by charging the paste block prepared as above into the spike pit formed after pulling out the spike and then setting the spike again. Particularly, in the case where the anode has an upper layer without substantial flowability, it is preferred to reduce the contact resistance between the spike and the secondary carbon anode by charging the paste block together with the bonding paste to the spike pit and, thereafter, setting the spike again.

Figure 3:
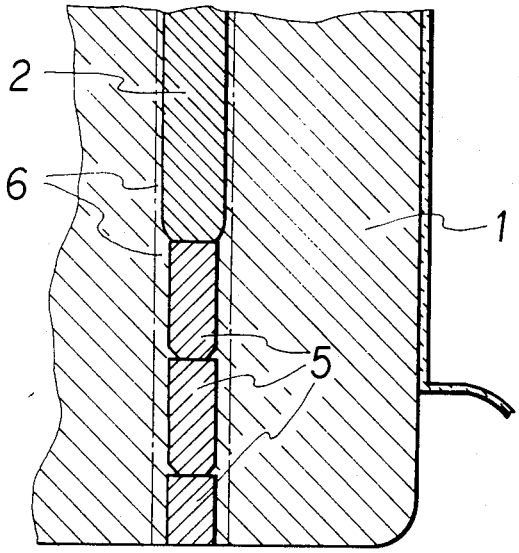
FIG. 3 is a schematic cross-sectional view for illustrating the manner of resetting a spike according to the present invention, in which both the paste block and the bonding paste are used.

FIG. 3 shows a schematic cross-sectional view illustrating the manner of resetting the spike according to the present invention, in which the paste block 5 and the bonding paste 6 are used together.

A preferred particle size distribution of the aggregate in the bonding paste comprises 20–40% by weight of fine particles which pass through Tyler standard mesh #200 and the balance of particles which are smaller than 5 mm in diameter, however, remain on the mesh #200. The weight ratio of the binder to the total amount of the paste has to be determined depending on a time period during which the bonding paste can be kept well-flowable after being charged in the spike pit and the binder content is, usually, between 30–40%, although it is desirable to restrict the content as little as possible, in view of environmental considerations. Use of such bonding paste with lower content of fine particles (passing through the mesh #200) and higher content of particles smaller than 5 mm in diameter which remain on the mesh #200, enables one to obtain the secondary carbon anode with raised strength, suppressed occurrence of cracks and excellent bondability. In the case where the content of particles which pass through the mesh #200 is much lower than 20%, the strength of the secondary carbon anode is remarkably reduced. On the other hand, if the content of particles which pass through the mesh #200 is much higher than 40%, remarkable shrinkage occurs in the block thereby tending to induce cracks, and the increased amount of the binder tends to cause and increase the occurrence of fumes due to the rapid baking of the bonding paste upon charging into the spike pit.

As stated above, a desirable secondary anode can be formed in the pits of the spikes by the method of resetting the anode spike according to the present invention. Furthermore, since the same effects as those obtained by a baked block can be attained by the use of an unbaked paste block according to the present invention, it provides increased economy.

The concrete mode of prosecution of the present invention will be described more specifically while referring to the following non-limitative example.

EXAMPLE

Comparative Example

Anode spikes were reset by the method according to the present invention. A paste block was prepared by molding a packing paste containing 79% by weight of an aggregate of the same particle size distribution as that for the primary anode and 21% by weight of a binder under a molding pressure of 250 kg/cm$^2$ into a configuration conforming to that of the top end of the anode spike. The paste block was used together with a bonding paste including 63% by weight of an aggregate containing 35% by weight of particles which pass through Tyler standard mesh #200 and 65% by weight of particles smaller than 5 mm in diameter, but which remain on the mesh #200, and 37% by weight of a binder. As the comparison, another resetting of the anode spikes were also carried out by the prior method, wherein a packing paste including 60% by weight of an aggregate containing 40% by weight of particles which pass through the mesh #200 and 60% by weight of particles which remains on the mesh #200, and 40% by weight of a binder was used without being molded.

Actual results of the operation of the electrolytic furnace were compared between both of the methods as shown in the Table, in which "recess at the bottom of the secondary anode" means the state as shown in FIG. 1.

TABLE

| | | Present Invention | Comparative Example (Prior method) |
|---|---|---|---|
| Anode voltage drop (mV) | | 380 | 470 |
| Power consumption (KWH/t-Al) | | 13,000 | 13,300 |
| Percentage of the number of recesses at the bottom of the secondary anode which had the depth of greater than 50 mm. | Greater than 50 mm | 0% | 50% |
| | Greater than 100 mm | 0% | 15% |

As shown in the table, remarkable improvements could be attained by the method according to the present invention. Further, it has also been confirmed as the result of various considerations that the anode voltage drop could be reduced by about 50 mV due to the improvement in the bonding paste (increasing the effect of a more rapid current issue from the spike by the shortening in the self-baking period due to the decrease in the required amount of the binder), and by about 40 mV due to the lowering in the spike position owing to the elimination of the recess at the bottom of the secondary anode.

What is claimed is:

1. A method of resetting an anode spike in a vertical type Söderberg electrolytic furnace for aluminum, comprising the steps of:

inserting at least one non-melting unbaked paste block prepared by molding a packing paste under pressure into a configuration conforming to that of the top end of said spike, together with a bonding paste, into a spike pit formed after pulling out said spike from an anode having an upper layer without substantial flowability; and resetting said spike in said spike pit.

2. The method according to claim 1, in which said packing paste includes an aggregate of coke containing 20–40% by weight of fine particles which pass through Tyler standard mesh #200, and pitch as a binder at a content of 15–25% by weight of the total amount of the packing paste.

3. The method according to claim 2, in which said bonding paste includes an aggregate containing 20–40% by weight of fine particles which pass through Tyler standard mesh #200 and the balance of particles which are smaller than 5 mm in diameter, but remain on the mesh #200, and a binder at a content of 30–40% by weight of the total amount of the bonding paste.

* * * * *